US010066280B2

(12) United States Patent
Ferraiuolo

(10) Patent No.: US 10,066,280 B2
(45) Date of Patent: Sep. 4, 2018

(54) AUSTENITIC TWIP STAINLESS STEEL, ITS PRODUCTION AND USE

(71) Applicant: Centro Sviluppo Materiali S.p.A., Rome (RM) (IT)

(72) Inventor: Alessandro Ferraiuolo, Rome (IT)

(73) Assignee: CENTRO SVILUPPO MATERIALI S.P.A., Rome (RM) (IT)

( * ) Notice: Subject to any disclaimer, the term of this patent is extended or adjusted under 35 U.S.C. 154(b) by 178 days.

(21) Appl. No.: 14/652,877

(22) PCT Filed: Dec. 18, 2013

(86) PCT No.: PCT/IB2013/061101

§ 371 (c)(1),
(2) Date: Jun. 17, 2015

(87) PCT Pub. No.: WO2014/097184

PCT Pub. Date: Jun. 26, 2014

(65) Prior Publication Data

US 2015/0329947 A1 Nov. 19, 2015

(30) Foreign Application Priority Data

Dec. 19, 2012 (IT) ..... RM2012A0647

(51) Int. Cl.
*C22C 38/42* (2006.01)
*C22C 38/44* (2006.01)
(Continued)

(52) U.S. Cl.
CPC ..... *C22C 38/58* (2013.01); *C21D 6/004* (2013.01); *C21D 6/005* (2013.01); *C21D 6/007* (2013.01); *C21D 6/008* (2013.01); *C21D 8/005* (2013.01); *C22C 38/001* (2013.01); *C22C 38/02* (2013.01); *C22C 38/06* (2013.01); *C22C 38/38* (2013.01); *C22C 38/42* (2013.01); *C22C 38/44* (2013.01);
(Continued)

(58) Field of Classification Search
None
See application file for complete search history.

(56) References Cited

U.S. PATENT DOCUMENTS 6,274,084 B1 8/2001 Haudrechy
2010/0047105 A1 2/2010 Bergstrom et al.

FOREIGN PATENT DOCUMENTS

EP 0694626 A1 1/1996
EP 2060646 A1 5/2009
WO WO 99/32682 * 7/1999

OTHER PUBLICATIONS

J & L Type 201, "Austenitic Manganese Stainless Steel," Alloy Digest, ASM international, Nov. 1999,p. 1-2.*
(Continued)

*Primary Examiner* — Deborah Yee
(74) *Attorney, Agent, or Firm* — Lucas & Mercanti, LLP

(57) ABSTRACT

The object of the invention is an austenitic stainless steel with high plasticity induced by twinning with innovative chemical composition, and the use thereof in the automobile industry and in all applications wherein both a high resistance to corrosion and a high formability is requested, together with mechanical features of high-resistant steels. The invention also concerns a process for the production of this austenitic stainless steel with high twinning-induced plasticity.

8 Claims, 2 Drawing Sheets

(51) Int. Cl.

| | |
|---|---|
| ***C22C 38/48*** | (2006.01) |
| ***C22C 38/52*** | (2006.01) |
| ***C22C 38/58*** | (2006.01) |
| ***C21D 8/00*** | (2006.01) |
| ***C21D 7/00*** | (2006.01) |
| ***C21D 7/02*** | (2006.01) |
| ***C21D 7/13*** | (2006.01) |
| ***C21D 6/00*** | (2006.01) |
| ***C22C 38/06*** | (2006.01) |
| ***C22C 38/02*** | (2006.01) |
| ***C22C 38/00*** | (2006.01) |
| ***C22C 38/50*** | (2006.01) |
| ***C22C 38/46*** | (2006.01) |
| ***C22C 38/38*** | (2006.01) |
| ***C22C 38/54*** | (2006.01) |

(52) U.S. Cl.
CPC ..... *C22C 38/46* (2013.01); *C22C 38/48* (2013.01); *C22C 38/50* (2013.01); *C22C 38/52* (2013.01); *C22C 38/54* (2013.01)

(56) References Cited

OTHER PUBLICATIONS

Machine-English translation of Japanese publication No. 2009-030128, Hamada Junichi et al., Feb. 12, 2009.*

* cited by examiner

AUSTENITIC TWIP STAINLESS STEEL, ITS PRODUCTION AND USE

CROSS-REFERENCE TO RELATED APPLICATIONS

The present application is a 371 of PCT/IB2013/061101, filed Dec. 18, 2013, which claims the benefit of Italian Patent Application No. RM2012A000647, filed Dec. 19, 2012.

FIELD OF THE INVENTION

The present invention relates to the field of the austenitic stainless steels.

The subject of the invention is an austenitic stainless steel with a specific chemical composition providing, among other things, a Cr content ≥11% (by weight) and a manufacturing process determining a microstructure and a deformation mode so as to give to the product high mechanical properties in terms of mechanical resistance (UTS ultimate tensile strength: 700-1800 Mpa), in particular ductility (A80>80%) and high resistance to corrosion. The specific energy absorption, measured as area below the tension-deformation curve, is very high and in the order of 0.5-0.8 J/mm3. Such features make the steel according to the invention particularly suitable to the application in several fields such as automotive, the one of the components for domestic appliances and for structural uses.

BACKGROUND OF THE INVENTION

As it is known, in the current state of art the austenitic steels can be schematically separated into two large families: stainless austenitic steels (AISI200 and AISI300 series type) and steels with high content of Mn (Mn>11% by weight).

The austenitic steels with high Mn content (Hadfield type and TWIP steels) are steels wherein the stabilization of the austenitic structure is obtained by means of suitable additions of Mn and C. The TWIP austenitic steels with high Mn, Fe-22Mn-0.6C or Fe-22Mn-3Al-3Si type, constitute an independent family of steels in the field of the high resistant steels as they have definitely peculiar mechanical properties (UTS 700-1000 Mpa) and they are characterized above all by very high ductility (A80>60%) and work hardening. These steels have an austenitic structure with face-centered cubic lattice (FCC), together with a low energy of the stacking fault (SFE) promoting the activation of the deformation mechanisms by twinning (twinning induced mechanically).

In the last decade the TWIP steels have been object of an intense research activity as they are considered extremely interesting for the applications wherein high performances in terms of ductility, capability of hardening and energy absorption during deformation are requested (WO99/01585, EP0889144).

A limit of this typology of steels (TWIP with high Mn) is the poor resistance to corrosion thereof; for the application in the automotive field and more in general in all fields wherein the steel is exposed to a not protected and potentially corrosive environment, there is the need for protecting the steel by means of coating such as galvanizing. The problems of the zinc layer adhesion make the electrogalvanising process (EG) the most suitable one for the TWIP steels with high Mn.

In the state of art (WO2006/025412, US2012/0000580A) there are some proposals trying to obtain corrosion-resistant TWIP steels obtained by adding about 12% of Cr to the composition of the TWIP steel with high Mn. These variants have a chemical composition of the Fe-25Mn-12Cr-0.25C-0.3N type and they have not high level of resistance to corrosion and are not suitable to relatively corrosive environments.

A process for the industrial implementation of a high-resistant stainless steel (UTS>700 MPa), with high ductility (A80>80%), which at the same time is suitable for applications in corrosive environments, is not yet known to the state of art. Therefore, in different industrial fields, there is the need for having available a stainless steel able to offer an optimum compromise between cost of manufacturing cycle and mechanical properties, resistance to corrosion and high formability together with a good surface quality.

The TWIP austenitic steels with high Mn, apart from the poor resistance to corrosion and the difficulties linked to the galvanizing process, have additional criticalities linked to the manufacturing cycle, with high manufacturing costs, which strongly hinder the industrialization thereof, and therefore the application in fields such as the automotive one. Substantially, the most critical aspects are the following ones;

- ferro-alloy cost;
- hydrogen embrittlement (RFSR-CT-2005-00030, WO2012/07715A2);
- high resistance to hot and cold deformation;
- environmental problems in steel works linked to the high Mn content.

SUMMARY OF THE INVENTION

The above reported criticalities related to the TWIP austenitic steels are overcome by the steel according to the present invention which provides a stainless austenitic steel with a set of functional properties, in particular related to the ductility, forming ability and resistance to corrosion, significatively improved with respect to the austenitic steels of the current state of art (steels of TWIP type with high Mn and austenitic stainless steels).

The behaviour in hot and cold rolling of the invention steel is similar to the one reported for the conventional stainless steels of AISI304 type and considerably better than the one of the TWIP steels with high Mn. This allows being able to obtain thin thicknesses without the necessity of a double cold rolling and recrystallization annealing.

The steel according to the present invention is characterized by a specific chemical composition and a manufacturing process determining a microstructure in the finished product that allow to obtain products with high mechanical features in terms of ultimate tensile strength (UTS: 700-1000 Mpa) and ductility in particular (A80>60%).

The steel of the present invention can be manufactured in different format type such as, for example, coils, bars, tubes and it allows meeting effectively all application requests in all fields of the mechanical and manufacturing industry, wherein the requirements of high resistance to corrosion, excellent mechanical features, disposition to deep drawing and low costs are particularly important.

The chemical composition of the steel subject of the present invention was defined based upon a wide series of laboratory tests with the implementation of experimental casts. The produced alloys then were transformed into products by means of rolling and annealing.

The characterization of the microstructure and the mechanical properties of the produced samples allowed defining the composition intervals for single alloy elements or for combinations of alloy elements, independently the one from the other ones, therefor the products with the functional features claimed in the present invention and enlisted hereebelow were obtained.

Therefore the object of the present invention is an austenitic stainless steel with high twinning induced plasticity (TWIP steel) and high mechanical and formability properties defined by: Rp0.2 comprised between 250 and 650 MPa; UTS comprised between 700 and 1200 MPa; A80 comprised between 60 and 100%, characterized in that it has a chemical composition, expressed in percentage by weight, comprising the following elements: C 0.01-0.50; N 0.11-0.50; Mn 6-12; Ni 0.01-6.0; Cu 0.01-6.0; Si 0.001-0.5; Al 0.001-2.0; Cr 11-20; Nb 0.001-0.5; Mo 0.01-2.0; Co 0.01-2.0; the remaining portion being Fe and unavoidable impurities. Hereinafter, even if not indicated, percentages are meant as % by weight.

In an embodiment the steel of the invention further comprises at least one of the following elements with the following % by weight: Ti 0.001-0.5; V 0.001-0.5.

The presence of additional elements, such as Ta+Hf+W+Re, can be useful to further increase the mechanical resistance and the product's corrosion resistance. Therefore, an embodiment of the steel of the invention further comprises at least one of the following elements with the following % by weight: W 0.001-0.5; Hf 0.001-0.5; Re 0.001-0.5; Ta 0.001-0.5.

In order to obtain a better workability it is preferable that S+Se+Te<0.5 are present. To reduce casting defects it is preferable that P+Sn+Sb+As<0.2. Therefore an embodiment of the invention steel further comprises the following elements with the following % by weight: S+Se+Te<0.5 and/or P+Sn+Sb+As<0.2.

An additional object of the invention is an austenitic stainless steel as according to anyone of the previous claims, wherein the following elements have the following % by weight: C 0.01-0.15; N 0.11-0.30; Mn 7-10; Cr 16-18; Cu 0.01-3.0; Ni 1.0-5.0; Si 0.01-0.3; Al 0.01-1.5; Nb 0.02-0.3; Co 0.05-0.3; Mo 0.05-1.5.

Preferably the following elements have the following % by weight: C+N 0.15-0.5; Cu+Ni 3.0-5.0; Mo+Co 0.05-3.0; Nb+V+Ti 0.05-1.0.

The austenitic stainless steel of the invention after a deformation by 30% at room temperature, has a martensite volumetric fraction ($\varepsilon+\alpha'$) lower than 5% and which, during a cold deformation, forms twins in quantities, expressed in terms of volumetric fraction, comprised between 2 to 20%.

The microstructural examination of the samples produced according to the invention allowed to argue that the metallurgic mechanism, the basis of the excellent mechanical properties, is constituted by the TWIP (Twinning Induced Plasticity) behaviour of the steel. During deformation, inside the crystalline grains, twins nucleate induced by deformation (mechanical twins). Such behaviour which, by entity and character, was never observed in the stainless steel (Cr>10%), determines an evolution of the microstructure during deformation process completely new with respect to the state of art of the stainless steels.

Carbon and nitrogen contribute in stabilizing the austenite and they are decisive to obtain the wished mechanical features and to prevent the formation of martensitic phases during deformation. The sum thereof varies in the range of 0.12-1.00%. Manganese plays a determining role in the stabilization of the austenitic phase. The composition range thereof is 6-12%. Ni and Cu allow stabilizing the austenitic phase. For both elements the upper and lower limits of the composition range are 0.01 and 6.0%, respectively. Cr is the key element to obtain a high resistance to corrosion. The composition range thereof is 11-20%, which gives a resistance to corrosion much higher than the TWIP austenitic steels of the state of art. Al (aluminium) has the double function of increasing the energy of stacking fault and preventing the formation of martensite $\varepsilon$. Silicium tends to lower the value of stacking fault energy and it tends to promote the formation of martensite $\varepsilon$ and $\alpha'$.

The group of elements constituted by Niobium, Titanium, Cobalt, Tantalium, Hafnium, Molybdenium, Tungstenum and Rhenium plays a double metallurgic effect. The first effect is constituted by the improvement of the mechanical resistance and the corrosion resistance of the steel. The second effect consists in the effective hindering action of the cross-slip mechanism of the (partial) dissociated dislocations. This takes place by means of increasing the resistance to recombination of the partial dislocations representing the needed condition so that the cross-slip takes place. The metallurgic effect of these elements has then a fundamental importance as the cross-slip mechanism is the main antagonist of the nucleation of the deformation induced twins (mechanical twins). The quantities in weight percentage to be used of this group of elements are singularly comprised between 0.01-2% wt for Co and Mo; 0.001-0.5% wt for Nb, Ti and V; whereas at last for Ta, Hf, W and Re the quantities are comprised between 0.001 and 0.5% wt.

An additional object of the invention is a process for the production of the austenitic stainless steel as above described, characterized in that it comprises the following procedures:

- hot deformation of the steel under condition of product obtained by continuous casting or by ingot; or
- cold deformation with reduction ratio higher than 30% of the steel under condition of annealed hot rolled product or hot rolled not annealed product, the above-mentioned hot deformation or the above-mentioned cold deformation being followed by a possible recrystallization annealing, at a temperature in the range of 800-1200° C. for a time comprised in the range of 10-600 s, and by cooling at room temperature.

Preferably the cooling at room temperature is performed with a rate in the range of 1° C./s-100° C./s.

The cycle for manufacturing the steel according to the invention has an important role in obtaining the above-enlisted properties. In particular two cases are to be distinguished:

1) product obtained by means of hot deformation;
2) product obtained by means of cold deformation.

In the first case the product is obtained directly by the process of hot rolling the slabs (ingots, billets) obtained by the continuous casting processes. The product (for example belt, bar, wire rod, etc.), after hot rolling and cooling, in case can be annealed at high temperature or directly applied as partially re-crystallized.

Hereinafter the optimum annealing conditions are reported, wherein the thermal treatment can be schematized in three phases:

i) Heating stage until maximum temperature (0.01-50° C.);

ii) Soaking at maximum temperature (800-1200° C. for a time comprised between 10-3600 s);

iii) Cooling down to room temperature (cooling rate 1-100° C./s).

In case of cold rolled products the starting material of the cold cycle is constituted by the hot deformed product under conditions of hot rolling annealed or raw product. The optimum conditions of the cold manufacturing cycle can be defined as follows:

i) Reduction ratio of the cold rolling process higher than 30%;

ii) Heating until maximum temperature (10-50° C./s);

iii) Soaking at maximum temperature (800-1200° C. for a time higher than 10 s);

iv) Cooling down to room temperature (cooling rate 1-100° C./s).

An additional object of the invention is the use of the austenitic stainless steel as described above for manufacturing automobile components with complex geometry, for the energy absorption, for structural reinforcements and/or for applications by deep drawing wherein a high resistance to corrosion is requested.

BRIEF DESCRIPTION OF THE DRAWINGS

A description of embodiments of the invention will be now provided with the help of the figures and of the examples, with the purpose of making to understand objects, features and advantages thereof, not to be meant with limitative purpose.

DETAILED DESCRIPTION OF THE INVENTION

In the examples, PREN is the acronym of Pitting Resistance Equivalent Number and it is an index for the synthetic evaluation of the localized resistance to corrosion.

Example 1

Three different 1.0-thick cold strip samples were obtained from cold rolling of slabs produced by a continuous casting plant. The hot strips were cold rolled (50% reduction) and subjected to final recrystallization annealing according to the modes shown in Table 1.

TABLE 1

| Heating rate (° C./s) | Furnace temperature (° C.) | Soaking time (s) | Cooling rate (° C./s) |
|---|---|---|---|
| 20 | 1000 | 90 | 50 |

The chemical compositions of the considered steels are reported in the following table.

TABLE 2

| Example | C | N | Mn | Ni | Cu | Si | Al | Cr | Nb | Mo | Co |
|---|---|---|---|---|---|---|---|---|---|---|---|
| 1.1 (inv.) | 0.05 | 0.2 | 9.5 | 2 | 2 | 0.2 | 1.5 | 18 | 0.09 | 0.2 | 0.6 |

TABLE 2-continued

| Example | C | N | Mn | Ni | Cu | Si | Al | Cr | Nb | Mo | Co |
|---|---|---|---|---|---|---|---|---|---|---|---|
| 1.2 (inv.) | 0.1 | 0.2 | 9 | 1 | 4 | 0.25 | 0.001 | 18 | 0.1 | 1.5 | 0.5 |
| 1.3 (comparative) | 0.04 | 0.10 | 9 | 2 | 4 | 0.25 | 0.001 | 18 | — | — | — |

Table 3 shows the mechanical properties relevant to the steel of table 2.

TABLE 3

| Example | Yield Rp0.2 (Mpa) | Tensile strength UTS (MPa) | A80 (%) |
|---|---|---|---|
| 1.1 (inv.) | 360 | 850 | 90 |
| 1.2 (inv.) | 370 | 810 | 84 |
| 1.3 (comparative) | 345 | 710 | 45 |

Figure 1:
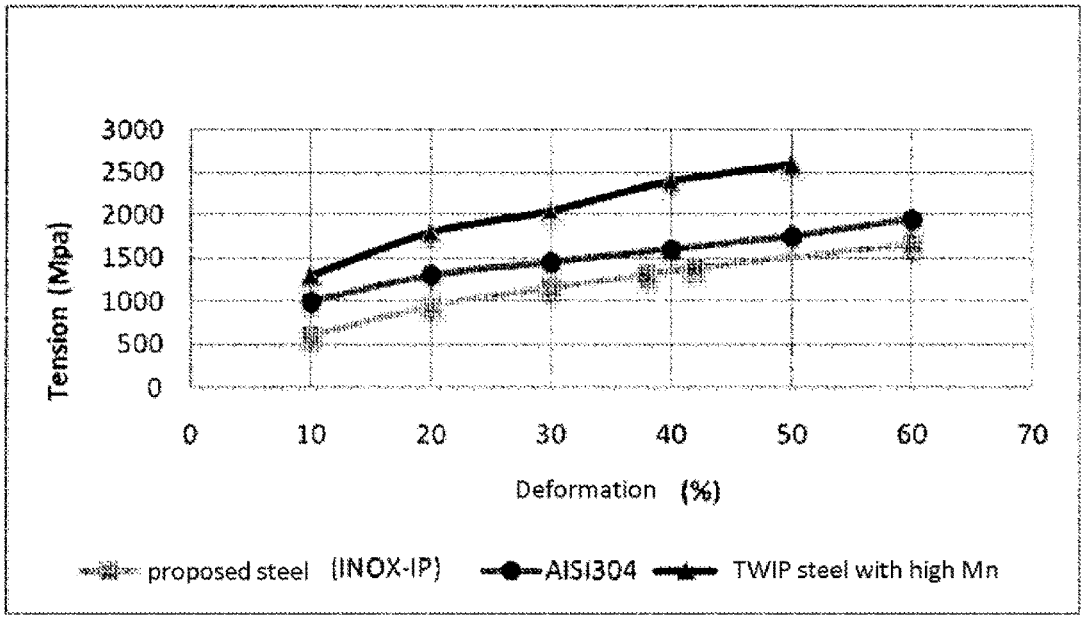
FIG. 1 shows the comparison, in terms of strain hardening during the cold deformation, of the steel according to the invention (INOX-IP) in the state of cold rolled and annealed strip with two reference steels AISI304 and TWIP steel with high Mn (TWIP-HIGH Mn).

The steels of the examples 1.1 and 1.2 show mechanical properties according to those of the present invention. The samples 1.1 and 1.2, deformed by 30% at room temperature, have both a percentage of twins higher than 8% and almost total lack of martensite ($\varepsilon+\alpha'$). FIG. 1 shows the comparison, in terms of hardening during cold deformation, of the steel related to the example 1.1 with the two reference steels AISI304 and TWIP steel with high Mn (TWIP-HIGH Mn).

The microstructure of the steel of example 1.1. after a deformation by 30% at room temperature has a martensite ($\varepsilon+\alpha'$) percentage lower than 1%. The percentage of twins, assessed by means of optical microscope, resulted to be 10%. The steel of the example 1.3, instead, has a poor TWIP effect during deformation (the fraction of twins present after the deformation by 30% is lower than 1%).

The corrosionistic properties of the subject examples are shown in the following table 4.

TABLE 4

| Example | PREN | EP (mV) | Critical Crevice Temperature (° C.) Co |
|---|---|---|---|
| 1.1 (inv.) | 22 | 300-500 | 10-15 |
| 1.2 (inv.) | 26 | 300-500 | 15-20 |
| 1.3 (comparative) | 20 | 400-500 | 5-15 |

Figure 3:
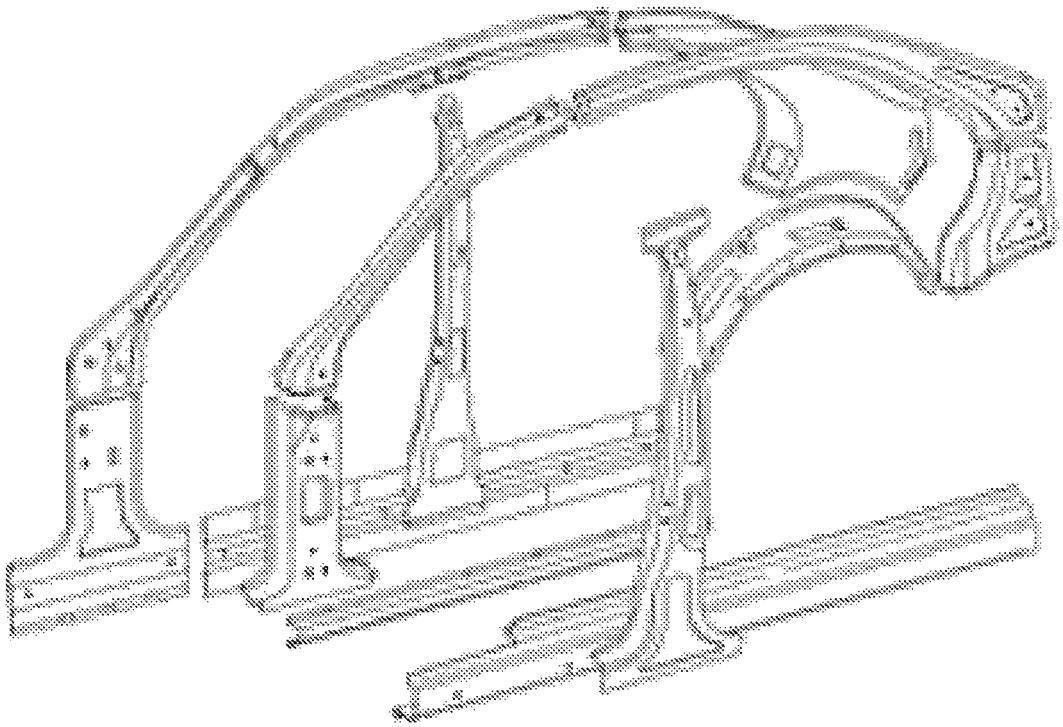
FIG. 3 shows the components supporting the automobile body roof (pillars) which can be manufactured with the steel of the present invention.

The products related to the examples 1.1 and 1.2 can be used for manufacturing automobile components requiring a good resistance to corrosion and a high mechanical resistance together with an excellent capability of energy absorption, such as the structural elements of automobiles. FIG. 3 shows the pillars of an automobile which can be obtained with the steels according to the examples 1.1 and 1.2. The pillars are the body portions whereupon the roof is supported and which have great importance for the structural strength of the body high portion.

Example 2

Two 10.0 mm-thick wire rods were obtained from hot rolling of billets produced by a continuous casting plant. The conditions of final recrystallization annealing of the wire rods are shown in the following table.

TABLE 5

| Furnace temperature (° C.) | Soaking time (s) | Cooling rate (° C./s) |
|---|---|---|
| 1000 | 120 | 50 |

The chemical composition of the subject wire rods is shown in the following table.

TABLE 6

| Example | C | N | Mn | Ni | Cu | Si | Al | Cr | Nb | Mo | Co | Ti |
|---|---|---|---|---|---|---|---|---|---|---|---|---|
| 2.1 (inv.) | 0.12 | 0.13 | 7 | 3 | 2 | 0.25 | 1.5 | 18 | 0.3 | 0.2 | 0.5 | 0.1 |
| 2.2 (comparative) | 0.25 | 0.35 | 9.5 | 2 | 0 | 0.2 | 1.5 | 10.5 | — | — | — | — |

Table 7 shows the mechanical features related to the steel of table 6.

TABLE 7

| Example | Yield Rp0.2 (Mpa) | Tensile strength UTS (MPa) | A80 (%) |
|---|---|---|---|
| 2.1 (inv.) | 320 | 780 | 88 |
| 2.2 (comparative) | 410 | 860 | 52 |

The mechanical properties of the steel 2.1 are excellent. In fact, the sample 2.1, deformed by 30% at room temperature, has a percentage of twins higher than 8% and total lack of martensite (ε+α'). On the contrary the chemical composition 2.2 shows a poor ductility.

Figure 2:
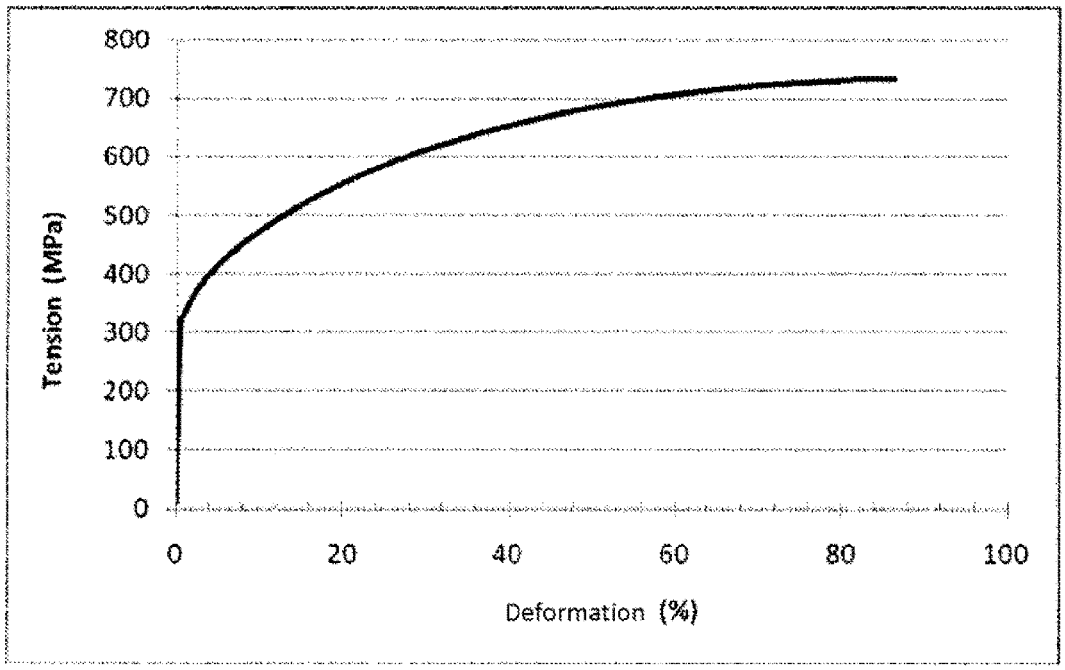
FIG. 2 shows the deformation curve (%) depending upon the tension in MPa at room temperature relevant to a test piece taken from a cold rolled and annealed strip.

The microstructure of the steel 2.2, deformed by 30% at room temperature, in fact, has a percentage of twins lower than 1%. The low fraction of twins produced during the deformation explains the low work hardening of the material and then the poor obtained ductility. FIG. 2 shows the diagram tension-deformation at room temperature of the steel related to the example 2.1.

The corrosionistic properties of the steels at issue are shown in the following table.

TABLE 8

| Example | PREN | EP (mV) | Critical Crevice Temperature (° C.) Co |
|---|---|---|---|
| 2.1 (inv.) | 22 | 400-600 | 10-15 |
| 2.2 (comparative) | 16 | 100-200 | <5 |

Example 3

Three samples of the same hot rolled strip with thickness of 2.0 mm were subjected to three different recrystallization annealing cycles shown in the following table with the purpose of verifying the effect of the annealing cycle on the final microstructure and on the mechanical properties.

TABLE 9

| Example | Heating speed (° C.) | Furnace temperature (° C.) | Keeping time (s) | Cooling speed (° C./s) |
|---|---|---|---|---|
| 3.1 (inv.) | 30 | 800 | 90 | 50 |
| 3.2 (inv.) | 20 | 1100 | 60 | 50 |
| 3.3 (comparative) | 0.01 | 700 | 36000 | 0.1 |

The chemical composition of the exemplified samples is shown in the following table 10.

TABLE 10

| C | N | Mn | Ni | Cu | Si | Al | Cr | Nb | Mo | Co | Ti | V | Ta |
|---|---|---|---|---|---|---|---|---|---|---|---|---|---|
| 0.1 | 0.25 | 8.5 | 2 | 1 | 0.2 | 0.1 | 17 | 0.05 | 1.0 | 0.05 | 0.08 | 0.1 | 0.1 |

The following table shows the mechanical properties related to the 3 examined samples.

TABLE 11

| Example | Yield Rp0.2 (Mpa) | Tensile strength UTS (MPa) | A80 (%) |
|---|---|---|---|
| 3.1 (inv.) | 580 | 910 | 50 |
| 3.2 (inv.) | 320 | 780 | 92 |
| 3.3 (comparative) | 380 | 680 | 39 |

In case of the example 3.1 the annealing at low temperature determined a partial recrystallization and a very fine grain size (about 1 μm). This allows obtaining a higher yielding stress value even if a high residual ductility is still kept.

The product related to the example 3.2 has mechanical features significantly higher than those of any stainless steel of the previous state of art. The properties of the steel of the example 3.3, instead, are significantly lower due to the precipitation of carbides during the annealing cycle. The microstructure of the example 3.3, after deformation by 30% at room temperature, is characterized by a percentage of martensite (ε+α') of 8%. The fraction of twins, assessed by optical microscope, resulted to be lower than 1%. The low fraction of twins produced during the deformation explains the low work hardening of the material and then the poor obtained ductility.

The corrosionistic properties of the herein exemplified steels are shown in the following table.

TABLE 12

| Example | PREN | EP (mV) | Critical Crevice Temperature (° C.) |
|---|---|---|---|
| 3.1, 3.2 (inv.) | 21 | 200-400 | 5-10 |
| 1.3 (comparative) | 21 | 100 | <5 |

In the steel of the comparative example 3.3 the not suitable process conditions determined mechanical and corrosionistic properties not appropriate for the application in the automotive field.

Example 4

Two 1.5 mm-thick strip samples of a steel according to the invention were obtained from hot rolling and subsequent cold rolling (50% reduction rate) and final annealing. The annealing conditions are shown in table 13.

TABLE 13

| Heating rate (° C.) | Furnace temperature (° C./s) | Soaking time (s) | Cooling rate (° C./s) |
|---|---|---|---|
| 150 | 35 | 90 | 50 |

The chemical composition of the subject samples are shown in the following table.

TABLE 14

| Example | C | N | Mn | Ni | Cu | Si | Al | Cr | Mo | Co | Nb | Ta | W |
|---|---|---|---|---|---|---|---|---|---|---|---|---|---|
| 4.1 (inv.) | 0.1 | 0.15 | 6.5 | 2 | 3 | 0.2 | 1.0 | 18 | 2 | 0.2 | 0.1 | 0.07 | 0.1 |
| 4.2 (comparative) | 0.1 | 0.09 | 8 | 4 | 2 | 1.0 | 1.5 | 18 | — | — | — | — | — |

Table 15 shows the mechanical properties related to the examples of table 14.

TABLE 15

| Example | Yield Rp0.2 (Mpa) | Tensile strength UTS (MPa) | A80 (%) |
|---|---|---|---|
| 4.1 (inv.) | 420 | 910 | 70 |
| 4.2 (comparative) | 360 | 820 | 45 |

The microstructure of the example 4.1 is characterized by a volumetric fraction of twins higher than 8% at a 30% deformation. Upon observing with the optical microscope the microstructure of the steel related to the example 4.2, deformed by 30%, the presence of twins was not revealed.

The corrosionistic properties of the steel considered in the present example are shown in table 16.

TABLE 16

| Example | PREN | Ep (mV) | Crevice Critical Temperature (° C.) |
|---|---|---|---|
| 4.1 (inv.) | 27 | 400-600 | 20-30 |
| 4.2 (comp.) | 19 | 300-400 | 10-15 |

The product obtained in the example 4.1 according to the invention underlined a high mechanical resistance together with a good resistance to corrosion and ductility. Such functional property makes this product more suitable than the comparative steel 4.2 for implementing automobile components.

The invention claimed is:

1. An austenitic stainless steel with high plasticity induced by twinning (TWIP steel) and high mechanical properties and formability defined by:

Rp0.2 between 250 and 650 MPa,

Rm between 810 and 1200 MPa,

A80 between 60 and 100%, comprising the following elements expressed in percentage by weight: C 0.01-0.50; N 0.11-0.50; Mn 6-12; Ni 0.01-6.0; Cu 0.01-6.0; Si 0.01-0.3; Al 0.01-1.5; Cr 11-20; Nb 0.001-0.5; Mo 0.01-2.0; Co 0.2-0.6;

optionally, at least one of Ti 0.001-0.5 or V 0.001-0.5; and the remaining portion being Fe and unavoidable impurities.

2. The austenitic stainless steel according to claim 1, further comprising at least one of the following elements with the following percentage by weight: W 0.001-0.5; Hf 0.001-0.5; Re 0.001-0.5; Ta 0.001-0.5.

3. The austenitic stainless steel according to claim 1 comprising the following elements with the following percentage by weight: S+Se+Te<0.5 and/or P+Sn+Sb+As<0.2.

4. The austenitic stainless steel according to claim 1, wherein the following elements have the following percentage by weight: C 0.01-0.15; N 0.11-0.30; Mn 7-10; Cr 16-18; Cu 0.01-3.0; Ni 1.0-5.0; Si 0.01-0.3; Al 0.01-1.5; Nb 0.02-0.3; Co 0.2-0.3; Mo 0.05-1.5.

5. The austenitic stainless steel according to claim 1, wherein the following elements have the following percentage by weight: C+N 0.15-0.5; Cu+Ni 3.0-5.0; Mo+Co 0.21-2.6; Nb+V+Ti 0.05-1.0.

6. The austenitic stainless steel according to claim 1, after a deformation of 30% at room temperature, having a martensite volumetric fraction ($\varepsilon+\alpha'$) lower than 5% and which, during a cold deformation, forms twins in quantities, expressed in terms of volumetric fraction, comprised between 2 to 20%.

7. A process for producing the austenitic stainless steel according to claim 1, comprising the following steps:

hot deformation of the steel under condition of product obtained by continuous casting or by ingot; or cold deformation with reduction rate higher than 30% of the steel product under condition of annealed hot rolled product or hot rolling raw product, the above-mentioned hot deformation or the above-mentioned cold deformation being followed by a possible recrystallization annealing, at a temperature in the range of 800-1200° C. for a time comprised in the range of 10-600 s, and by cooling at room temperature with a speed in the range of 1° C./s-100° C./s, wherein the austenitic stainless steel has high plasticity induced by twinning (TWIP steel) and high mechanical properties and formability defined by:

Rp0.2 between 250 and 650 MPa,

Rm between 810 and 1200 MPa,

A80 between 60 and 100%, comprising the following elements expressed in percentage by weight: C 0.01-0.50; N 0.11-0.50; Mn 6-12; Ni 0.01-6.0; Cu 0.01-6.0; Si 0.01-0.3; Al 0.01-1.5; Cr 11-20; Nb 0.001-0.5; Mo 0.01-2.0; Co 0.2-0.6;

optionally, at least one of Ti 0.001-0.5 or V 0.001-0.5; and the remaining portion being Fe and unavoidable impurities.

8. The austenitic stainless steel according to claim 1, wherein the austenitic stainless steel has an energy absorption of 0.5-0.8 Joules/$mm^3$.

* * * * *